US011618935B1

(12) United States Patent
Chen

(10) Patent No.: US 11,618,935 B1
(45) Date of Patent: Apr. 4, 2023

(54) MANUFACTURING METHOD OF ALUMINUM ALLOY WITH HIGH THERMAL CONDUCTIVITY

(71) Applicant: CHARNG CHYI ALUMINUM CO., LTD., Tainan (TW)

(72) Inventor: Sheng-I Chen, Tainan (TW)

(73) Assignee: CHARNG CHYI ALUMINUM CO., LTD., Tainan (TW)

( * ) Notice: Subject to any disclaimer, the term of this patent is extended or adjusted under 35 U.S.C. 154(b) by 0 days.

(21) Appl. No.: 17/657,129

(22) Filed: Mar. 30, 2022

(51) Int. Cl.
*C22C 1/02* (2006.01)
*B22D 7/00* (2006.01)
*C22C 21/02* (2006.01)

(52) U.S. Cl.
CPC ..... *C22C 1/026* (2013.01); *B22D 7/005* (2013.01); *C22C 21/02* (2013.01)

(58) Field of Classification Search
CPC ..... C22C 1/026; C22C 21/02
See application file for complete search history.

(56) References Cited

FOREIGN PATENT DOCUMENTS

CN 108913964 B * 4/2020 ..... B22D 11/003

OTHER PUBLICATIONS

English Translation of Gao et al. (CN 108913964) (Apr. 2020).*

* cited by examiner

*Primary Examiner* — Jessee R Roe

(57) ABSTRACT

A manufacturing method of an aluminum alloy with high thermal conductivity comprising steps of: preparing materials including pure aluminum ingots, silicon alloy, iron alloy and magnesium alloy; melting the pure aluminum ingots in a reverberatory furnace at two stages, melting, stirring, sampling for compositions determination; transferring the molten aluminum into a holding furnace, putting the ingots in, melting, removing slag, determining the compositions; calculating amount of the alloys to be added; melting the silicon alloy and iron alloy in the molten aluminum and analyzing the compositions; adding the ingots to cool the temperature of the molten aluminum down and then adding the magnesium alloy, confirming and making corrections if insufficient compositions; degassing and purifying the molten aluminum by adding drossing flux in the furnace and making a final compositions determination; transferring the molten aluminum into online degassing system to degas and purify; casting the molten aluminum into aluminum alloy ingots.

2 Claims, 2 Drawing Sheets

Unit: weight%

| | | | | | | |
|---|---|---|---|---|---|---|
| Si:0.05max | Fe:0.15max | Cu:0.01max | Mn:0.01max | Mg:0.01max | Cr:0.01max | Sb:0.05max |
| Ni:0.01max | Zn:0.01max | Pb:0.01max | Sn:0.01max | Ti:0.01max | Bi:0.01max | Li:0.01max |

FIG.2

Unit: weight%

| | | | | | | |
|---|---|---|---|---|---|---|
| Si:2.0~5.0 | Fe:0.40~0.50 | Cu:0.01max | Mn:0.01max | Mg:0.4~0.6 | Cr:0.01max | Sb:0.05max |
| Ni:0.01max | Zn:0.01max | Pb:0.01max | Sn:0.01max | Ti:0.01max | Bi:0.01max | Li:0.01max |

FIG.3

MANUFACTURING METHOD OF ALUMINUM ALLOY WITH HIGH THERMAL CONDUCTIVITY

BACKGROUND OF THE INVENTION

Field of Invention

The invention relates to a manufacturing method of an aluminum alloy with high thermal conductivity.

Related Art

General aluminum alloy ingots are mainly made of pure aluminum and recycled aluminum, and other elements are added in accordance with international standards or special requirements, such as: silicon (Si), magnesium (Mg), iron (Fe), etc., to improve alloys formulated with pure aluminum generally used in the foundry industry with insufficient castability, chemical properties and physical properties.

With the rapid development of science and technology, performance and precision requirements of equipment are getting higher and higher. Harsh operating environment requirements are demanded for precision equipment, and temperature control is an important part of ensuring equipment operation. Temperature control of most equipment is closely related to heat sink, but in order to improve the heat dissipation performance of heat sink, in addition to structural changes, the most fundamental part is improvement of the heat dissipation performance of heat sink materials. Therefore, it is necessary to develop a more reasonable manufacturing method capable of preparing high-quality heat-dissipating materials that can be formed and processed to meet the requirements of equipment configured with higher heat generation, and provide a guarantee for improving the integration degree and reducing the size of various equipment. However, in actual production, the currently available aluminum alloy materials have poor heat conduction performance, requirements for the heat dissipation performance of products used in the rapidly developing communications industry are constantly increasing, but the heat dissipation performance of the currently available aluminum alloy products is incapable of meeting the requirements of the communications industry.

SUMMARY OF THE INVENTION

A main object of the invention is to address the deficiencies in manufacturing and ratio and composition of raw materials of the existing aluminum alloy materials by providing a manufacturing method of an aluminum alloy with high thermal conductivity capable of being formed and processed efficiently and with good heat dissipation effect.

The manufacturing method of the aluminum alloy with high thermal conductivity of the invention comprising steps of:

1. preparing materials: pure aluminum (Al) ingots, silicon (Si) alloy, iron (Fe) alloy, magnesium (Mg) alloy;

2. putting the pure aluminum (Al) ingots into a reverberatory furnace at two stages: at first stage, a weight percentage of the pure aluminum (Al) ingots being 40% of the usage amount, heating the reverberatory furnace up to temperature between 660° C.~690° C. in order to melt and stir the pure aluminum ingots, taking 3-5 hours to melt firstly, stirring once or twice and each stirring taking 3-10 minutes after first melting, sampling for a first compositions determination after completion of the first melting, at second stage, a weight percentage of the pure aluminum (Al) ingots being 47%~48% of the usage amount so that the total usage amount at the two stages being 87%~88%, taking 1~3 hours to melt secondly, stirring once or twice and each stirring taking 3~10 minutes after second melting, sampling for a second compositions determination after completion of the second melting;

3. transferring the molten aluminum (Al) from the reverberatory furnace into a holding furnace: reconfirming the compositions after transferring the molten aluminum (Al) from the reverberatory furnace into the holding furnace, then inputting about 4~5% of the usage amount of the pure aluminum (Al) ingots as third melting by temperature between 660° C.~690° C., removing the aluminum slag on a surface of the molten aluminum (Al) by raking after third melting, confirming the compositions again;

4. calculating and preparing amount of the silicon (Si) alloy, iron (Fe) alloy, magnesium (Mg) alloy and the aluminum (Al) ingots to be added: calculating and preparing amount of the alloys to be added including a weight percentage of silicon (Si) alloy being 2.0%~5%, a weight percentage of iron (Fe) alloy being 0.4%~0.5%, a weight percentage of magnesium (Mg) alloy being 0.4%~0.6%, moreover, preparing the pure aluminum (Al) ingots with a weight percentage of 4~5% as a cooling material;

5. adding the silicon (Si) alloy and iron (Fe) alloy into molten aluminum (Al) in the holding furnace: firstly, inputting silicon (Si) alloy and iron (Fe) alloy prepared in step 4 into the holding furnace, taking 0.5~1 hour to melt at temperature range between 730° C.~750° C., stirring thoroughly, analyzing the compositions after stirring, analyzed values being used as initial values for subsequent alloy addition and correction;

6. putting the pure aluminum (Al) ingots to cool the temperature down, and adding the magnesium (Mg) alloy: putting the pure aluminum (Al) ingots prepared in step 4 into the molten aluminum (Al) in the holding furnace to cool the temperature down to 680° C.~710° C., adding the magnesium (Mg) alloy into the holding furnace with a melting time of 15~20 minutes after cooling, confirming the compositions after melting, for insufficient compositions in other master alloys, making corrections during this melting process;

7. degassing and purifying in the holding furnace: using granulated drossing flux with nitrogen to spray into the holding furnace as first degassing and purifying, after spreading, stirring thoroughly for 20~30 minutes and controlling the molten aluminum (Al) temperature at 660° C.~710° C., removing the impurities from the surface of the molten aluminum (Al) after stirring, then letting the molten aluminum (Al) stand (without stirring) for about 15~30 minutes, making a final compositions determination;

8. degassing and purifying by online degassing system: confirming a temperature of the molten aluminum (Al) being between 660° C. and 710° C. after pouring from the holding furnace into the online degassing system, then, the molten aluminum (Al) being secondly degassed and purified by the online degassing system; and 9. casting aluminum (Al) alloy ingots: after online degassing and purifying, casting aluminum (Al) ingots to make the aluminum (Al) alloy ingots with high thermal conductivity.

In the aluminum alloy with high thermal conductivity of the invention, wherein the aluminum (Al) alloy ingot with high thermal conductivity is mainly composed of aluminum (Al), silicon (Si), iron (Fe), magnesium (Mg), antimony (Sb), copper (Cu), zinc (Zn), manganese (Mn), nickel (Ni), chromium (Cr), titanium (Ti), lead (Pb), tin (Sn), bismuth (Bi), lithium (Li) and M components, weight percentages of the components are as follows: silicon (Si) 2.0%~5.0%, iron (Fe) 0.4~0.5%, magnesium (Mg) 0.4~0.6%, antimony (Sb) less than 0.05%, contents of copper (Cu), zinc (Zn), manganese (Mn), nickel (Ni), chromium (Cr), titanium (Ti), lead (Pb), tin (Sn), bismuth (Bi), lithium (Li) elements are less than 0.01%, and M is another element with a content being limited to less than 0.005%, and the balance is aluminum (Al).

The manufacturing method of the aluminum alloy with high thermal conductivity of the invention has the advantages that it has the characteristics of being conducive to die-casting, semi-solid, casting molding, and easy processing of finished products, and at the same time has superior heat conduction effect capable of improving the heat conduction performance of aluminum alloy products to meet the requirements of special industries for thermal conductivity of aluminum alloy materials.

BRIEF DESCRIPTION OF THE DRAWINGS

FIG. 2 is a compositions determination chart of one embodiment of the invention.

FIG. 3 is a final compositions determination chart of one embodiment of the invention.

DETAILED DESCRIPTION OF THE INVENTION

Figure 1:
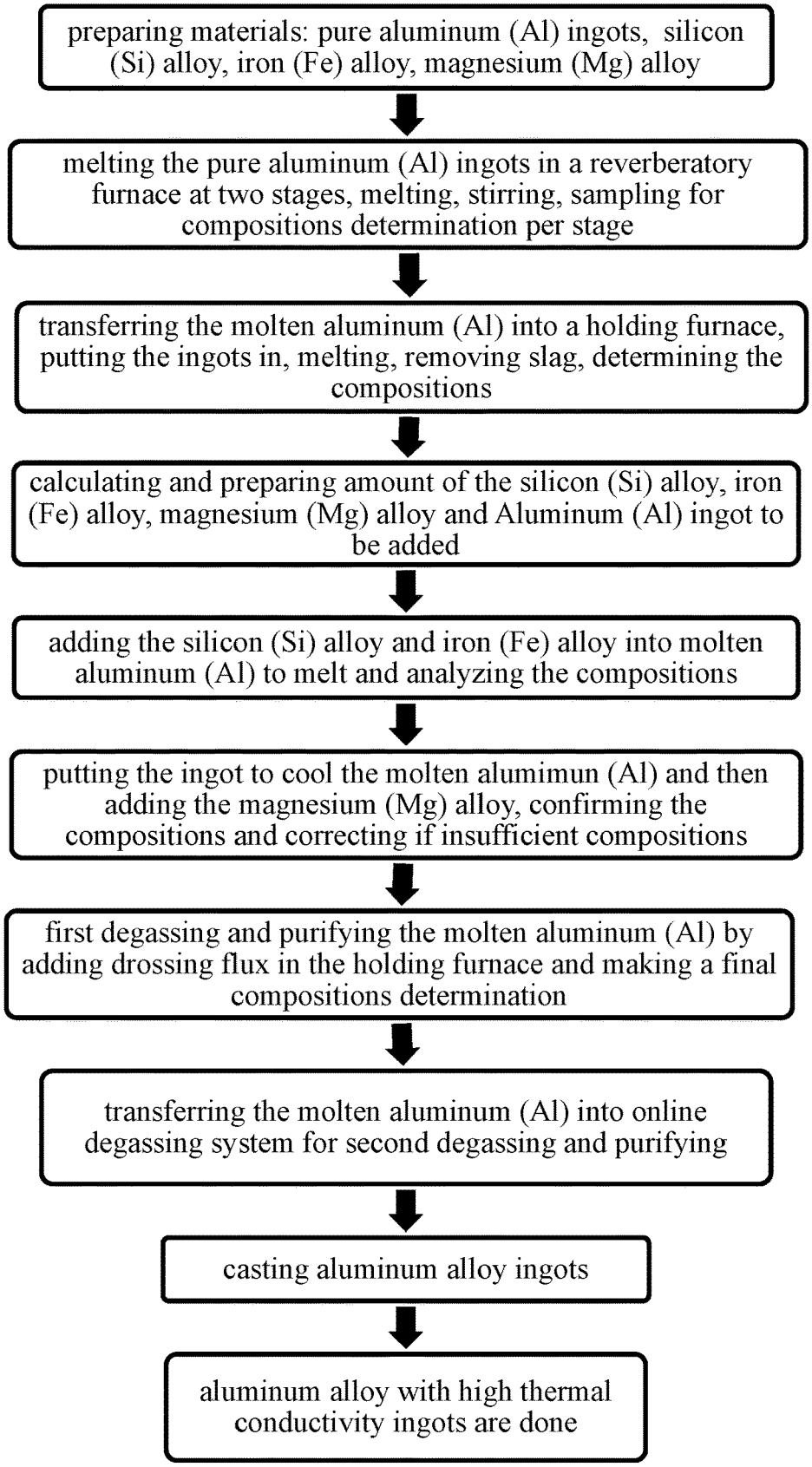
FIG. 1 is a flow chart of a manufacturing method of one embodiment of the invention.

Regarding the technical means adopted by the invention to achieve the above-mentioned object and efficacies, a preferred and feasible embodiment is explained in details hereunder in conjunction with the figures.

In a manufacturing method of an aluminum alloy with high thermal conductivity of the invention, in order to ensure that there are no impurities in a reverberatory furnace, the furnace is cleaned firstly by pure aluminum (Al) ingots. After the furnace is cleaned and drained, the manufacturing steps of the aluminum alloy with high thermal conductivity are able to initiate and the steps are comprising: (please refer to FIG. 1)

1. preparing materials: pure aluminum (Al) ingots, silicon (Si) alloy, iron (Fe) alloy, magnesium (Mg) alloy;

2. putting the pure aluminum (Al) ingots into a reverberatory furnace at two stages: at first stage, a weight percentage of the pure aluminum (Al) ingots being 40% of the usage amount, heating the reverberatory furnace up to temperature between 660° C.~690° C. in order to melt and stir the pure aluminum (Al) ingots, taking 3~5 hours to melt firstly, stirring once or twice after the first melting and each stirring taking 3~10 minutes, sampling for a first compositions determination after completion of the first melting, at second stage, a weight percentage of the pure aluminum (Al) ingots being 47%~48% of the usage amount so that the total usage amount at the two stages being 87% 88%, taking 1~3 hours to melt secondly, stirring once or twice and taking 3~10 minutes to stir after the second melting, sampling for a second compositions determination after completion of the second melting; the two compositions determinations must be in accordance with the chart in FIG. 2

3. transferring the molten aluminum (Al) from the reverberatory furnace into a holding furnace: after transferring the molten aluminum (Al) from the reverberatory furnace into the holding furnace, reconfirming the compositions, then inputting about 4~5% of the usage amount of the pure aluminum (Al) ingots as third melting, by temperature between 660° C.~690° C., after the completion of the third melting, removing the aluminum (Al) slag on a surface of the molten aluminum (Al) by raking, reconfirming the compositions with judgment standard as shown in the chart in FIG. 2;

4. calculating and preparing amount of silicon (Si) alloy, iron (Fe) alloy, magnesium (Mg) alloy and aluminum (Al) ingots to be added: calculating and preparing amount of the alloys to be added including a weight percentage of silicon (Si) alloy being 2.0%~5%, a weight percentage of iron (Fe) alloy being 0.4%~0.5%, a weight percentage of magnesium (Mg) alloy being 0.4%~0.6%, moreover, preparing the pure aluminum (Al) ingots with a weight percentage of 4~5% as a cooling material;

5. adding the silicon (Si) alloy and iron (Fe) alloy into molten aluminum (Al) in the holding furnace: firstly, inputting silicon (Si) alloy and iron (Fe) alloy prepared in step 4 in the holding furnace, taking 0.5~1 hour to melt at temperature range between 730° C.~750° C., stirring thoroughly, analyzing the compositions after stirring, analyzed values being used as initial values for subsequent alloy addition and correction;

6. putting the pure aluminum (Al) ingots to cool the temperature down, and adding the magnesium (Mg) alloy: putting the pure aluminum (Al) ingots prepared in step 4 into the molten aluminum (Al) in the holding furnace to cool the temperature down to 680 ° C.~710 ° C., adding the magnesium (Mg) alloy into the holding furnace with a melting time of 15~20 minutes after cooling, confirming the compositions after melting, for insufficient compositions in other master alloys, making corrections during this melting process; a minimum balance of aluminum (Al) being 93.6% min, the compositions confirmation standard being shown in the chart in FIG. 3;

7. degassing and purifying in the holding furnace: using granulated drossing flux in a powder spreading device with nitrogen in order to spray into the holding furnace as first degassing and purifying, the granulated drossing flux could be NIKKIN N200 with dosage: 20 kgs and ratio of 1 metric ton of the molten aluminum (Al) to 1 kg of the drossing flux, after completion of the drossing flux spreading, stirring thoroughly for 20~30 minutes and controlling the molten aluminum (Al) temperature at 660° C.~710° C., removing the impurities from the surface of the molten aluminum (Al) after stirring, then letting the molten aluminum (Al) stand (without stirring) for about 15~30 minutes, making a final compositions determination, judgment standard as shown in the chart in FIG. 3;

8. degassing and purifying by online degassing system: confirming a temperature of the molten aluminum (Al) being between 660° C. and 710° C. after pouring from the holding furnace into a T-shape rotor manufactured by STAS, in the online degassing system, then, the molten aluminum (Al) being rotated and stirred by the rotor as second degassing and purifying; and 9. casting aluminum (Al) alloy ingots: after online degassing and purifying, casting aluminum (Al) ingots to make the aluminum (Al) alloy ingots with high thermal conductivity.

The aluminum alloy with high thermal conductivity manufactured by the above steps of the invention is mainly composed of aluminum (Al), silicon (Si), iron (Fe), magnesium (Mg), antimony (Sb), copper (Cu), zinc (Zn), manganese (Mn), nickel (Ni), chromium (Cr), titanium (Ti), lead (Pb), tin (Sn), bismuth (Bi), lithium (Li) and M components, weight percentages of the components are as follows: silicon (Si) 2.0%~5.0%, iron (Fe) 0.4~0.5%, magnesium (Mg) 0.4~0.6%, antimony (Sb) less than 0.05%, contents of copper (Cu), zinc (Zn), manganese (Mn), nickel (Ni), chromium (Cr), titanium (Ti), lead (Pb), tin (Sn), bismuth (Bi), lithium (Li) elements are less than 0.01%, and M is another element (such as silver Ag, boron B, beryllium Be, calcium Ca, cadmium Cd, cobalt Co, gallium Ga, mercury Hg, indium In, sodium Na, strontium Sr, etc.) with a content being limited to less than 0.005%, and the balance is aluminum (Al), a minimum balance of aluminum (Al) is 93.6% min.

The manufacturing equipment of the invention is a reverberatory furnace and a holding furnace for melting. The molten aluminum is finally subjected to the second online degassing and purifying system using the T-shape rotor manufactured by STAS, and then an automatic casting machine is used to cast the aluminum alloy ingots to produce the aluminum alloy ingot products with high thermal conductivity. The aluminum alloy ingot with high thermal conductivity can be formed and processed efficiently to be used for conventional aluminum alloy die-casting, aluminum alloy semi-solid die-casting and casting. The products can be applied in parts of portable electronic devices, 5G communication equipment, automotive electronic parts, aerospace and satellite communications, and other parts and components with high heat dissipation and high heat conduction requirements.

In summary, the invention has indeed achieved the intended object and efficacy of use, and is more ideal and practical than the prior art. However, the above-mentioned embodiment is merely the specific description of the preferred embodiment of the invention, the embodiment is not intended to limit the claims of the invention, and all other equivalent changes and modifications completed without departing from the technical means disclosed in the invention should be included in the claims covered by the invention.

What is claimed is:

1. A manufacturing method of aluminum alloy comprising steps of:

i. preparing materials: pure aluminum ingots, silicon (Si) alloy, iron (Fe) alloy, magnesium (Mg) alloy;

ii. melting the pure aluminum ingots in a reverberatory furnace at two stages: at first stage, a weight percentage of the pure aluminum ingots being 40% of the usage amount, heating the reverberatory furnace up to temperature between 660° C.~690° C. in order to melt and stir the pure aluminum ingots, taking 3~5 hours to melt firstly, stirring once or twice after the first melting and each stirring taking 3~10 minutes, sampling for a first compositions determination after completion of the first melting, at second stage, a weight percentage of the pure aluminum ingots being 47%~48% of the usage amount so that the total usage amount at the two stages being 87%~88%, taking 1~3 hours to melt secondly, stirring once or twice and taking 3~10 minutes to stir after the second melting, sampling for a second compositions determination after completion of the second melting;

iii. transferring the molten aluminum from the reverberatory furnace into a holding furnace: after transferring the molten aluminum from the reverberatory furnace into the holding furnace, reconfirming the compositions, then inputting about 4~5% of the usage amount of the pure aluminum ingots as third melting, by temperature between 660° C.~690° C., after the completion of the third melting, removing the aluminum slag on judgment standard;

iv. calculating and preparing amount of the silicon (Si) alloy, iron (Fe) alloy, magnesium (Mg) alloy and aluminum (Al) to be added: calculating and preparing amount of the alloys to be added including a weight percentage of silicon (Si) alloy being 2.0%~5%, a weight percentage of iron (Fe) alloy being 0.4%~0.5%, a weight percentage of magnesium (Mg) alloy being 0.4%~0.6%, moreover, preparing the pure aluminum ingots with a weight percentage of 4~5% as a cooling material;

v. adding the silicon (Si) alloy and iron (Fe) alloy into molten aluminum in the holding furnace: firstly, inputting silicon (Si) alloy and iron (Fe) alloy prepared in step 4 in the holding furnace, taking 0.5~1 hour to melt at temperature range between 730° C.~750° C., stirring thoroughly, analyzing the compositions after stirring, analyzed values being used as initial values for subsequent alloy addition and correction;

vi. putting the pure aluminum ingots to cool the temperature down, and adding the magnesium (Mg) alloy: putting the pure aluminum ingots prepared in step 4 into the molten aluminum in the holding furnace to cool the temperature down to 680° C.~710° C., adding the magnesium (Mg) alloy into the holding furnace with a melting time of 15~20 minutes after cooling, confirming the compositions after melting, for insufficient compositions in other master alloys, making corrections during this melting process;

vii. degassing and purifying in the holding furnace: using granulated drossing flux with nitrogen to spray into the holding furnace as first degassing and purifying, after spreading, stirring thoroughly for 20~30 minutes and controlling the molten aluminum temperature at 660° C.~710° C., removing the impurities from the surface of the molten aluminum after stirring, then letting the molten aluminum stand for about 15~30 minutes, making a final compositions determination;

viii. degassing and purifying by online degassing system: confirming a temperature of the molten aluminum being between 660° C.~710° C. after pouring into the online degassing system, the molten aluminum being second degassed and purified by the online degassing system; and ix. casting aluminum alloy ingots: after online degassing and purifying, casting aluminum ingots to make the aluminum alloy ingots with high thermal conductivity.

2. The manufacturing method of aluminum alloy as claimed in claim 1, wherein the aluminum alloy is mainly composed of aluminum (Al), silicon (Si), iron (Fe), magnesium (Mg), antimony (Sb), copper (Cu), zinc (Zn), manganese (Mn), nickel (Ni), chromium (Cr), titanium (Ti), lead (Pb), tin (Sn), bismuth (Bi), lithium (Li) and M components, weight percentages of the components are as follows: silicon (Si) 2.0%~5.0%, iron (Fe) 0.4~0.5%, magnesium (Mg) 0.4~0.6%, antimony (Sb) less than 0.05%, contents of copper (Cu), zinc (Zn), manganese (Mn), nickel (Ni), chromium (Cr), titanium (Ti), lead (Pb), tin (Sn), bismuth (Bi), lithium (Li) elements are less than 0.01%, and M is another element with a content being limited to less than 0.005%, and the balance is aluminum (Al).

* * * * *